US005791050A

United States Patent [19]

Masi

[11] Patent Number: 5,791,050

[45] Date of Patent: Aug. 11, 1998

[54] ELECTRIC SHAVER MANIPULATOR FOR DISABLED

[76] Inventor: Frederick T. Masi, 5451 Burger, Dearborn Heights, Mich. 48127

[21] Appl. No.: 787,054

[22] Filed: Jan. 28, 1997

[51] Int. Cl.[6] ..... B26B 19/38

[52] U.S. Cl. ..... 30/34.05; 30/296.1; 30/340; 83/574

[58] Field of Search ..... 83/574; 30/32, 30/34.05, 296.1, 298.4, 340

[56] References Cited

U.S. PATENT DOCUMENTS

| | | | |
|---|---|---|---|
| 2,558,217 | 6/1951 | Hess | 83/574 |
| 2,584,620 | 2/1952 | Rubin | 30/296.1 X |
| 3,389,323 | 6/1968 | Jepson et al. | 30/34.05 X |
| 4,064,625 | 12/1977 | Mansfield | 30/296.1 X |

*Primary Examiner*—Douglas D. Watts

[57] ABSTRACT

Described is manipulator and method of use thereof wherein the manipulator has a firmly standing base and provision for mounting, running and presenting differently thereon commercially available, normally hand held electric razors on a turntable rotatable about the base. Rotation of the turntable presents blades of the razor to the user differently so facial hair on various parts of the face may be shaved through movement of the user's head and razor rotation. The manipulator enables users with limited hand and arm coordination to shave independently.

Preferred elastomeric means for carrying the razor on the turntable improves shaving comfort.

4 Claims, 4 Drawing Sheets

ELECTRIC SHAVER MANIPULATOR FOR DISABLED

BACKGROUND OF THE INVENTION

This invention relates to devices that assist persons in shaving and, in particular, a device aiding in manipulation of hand held electric razors. This invention, more particularly, relates to a device that permits its user to manipulate commercially available, normally hand held electric razors in shaving facial hair with little hand and arm participation. This invention provides capacity for such a user to change presentation of the razor for independently shaving hair from the neck, chin, cheeks and other parts of the face.

Devices assisting shaving with electric razors are known. For example, one commercially available device comprises a strap or band that binds an electric razor to the hand. And, U.S. Pat. No. 2,329,891 discloses a device for modulating an electric razor presentation by simulating hand movement in shaving. Neither of these devices are useful for shaving by persons having minimal coordinated hand and arm movement.

U.S. Pat. No. 4,064,625 discloses an apparatus said to be useful by persons having little or no use of their limbs. In contrast to U.S. Pat. No. '625, Applicant's invention provides for changing presentation of the electric razor by the user in shaving different parts of the face. Changes in presentation are accomplished through rotation of a turntable carrying an electric razor and head movement according to applicant's invention

OBJECTS OF THE INVENTION

It is an object of this invention to provide a device that enables its user to shave independently;

It is an object of this invention to provide such a device that is capable of modification to yield a comfortable shave;

It is an object of this invention to provide such a device that can utilize commercially available, normally hand held razors.

These and other objects are accomplished by this invention as will be appreciated from the following disclosure.

BRIEF DESCRIPTION OF THE INVENTION

The manipulator of this invention is useful when combined with commercially available electric razors, particularly corded razors that have blades at an oblique angle relative the razor handle, and enables shaving independently using head movement and little hand and arm involvement with the razor itself.

The manipulator comprises a base having a top and bottom, the top having an opening. A turntable, mounted to, and rotatable around the top, has an opening through the turntable that communicates with the opening in the top. Means for holding an electric razor upright mounts the turntable such that blades of the razor stand above the turntable. The manipulator has means for stopping turntable rotation and release of that stoppage.

Preferred manipulators comprise (a) a plurality of positioning holes spaced around a periphery of the turntable, (b) a guide in the top, the guide in registry with a first and other of the positioning holes as the turntable is rotated around the top, (c) a side extending between the top and bottom, the side having a slot extending a length between the top and bottom, (d) an "L" shaped rod attached to a first spring end, a first leg of the rod fitting in the slot and a second leg fitting endwise respectively both in the guide and any of the positioning holes in registry above the guide and (e) a mount holding an end of the spring away from the first spring end such that depression of the first leg withdraws the second leg from a positioning hole of the turntable.

A person using the manipulator that has an electric razor shaves facial hair by head movement for contact between blades of the razor and areas of facial hair to be shaven and rotation of the turntable to change of razor presentation for the contact.

DETAILED DESCRIPTION OF PREFERRED EMBODIMENTS

Figure 1:
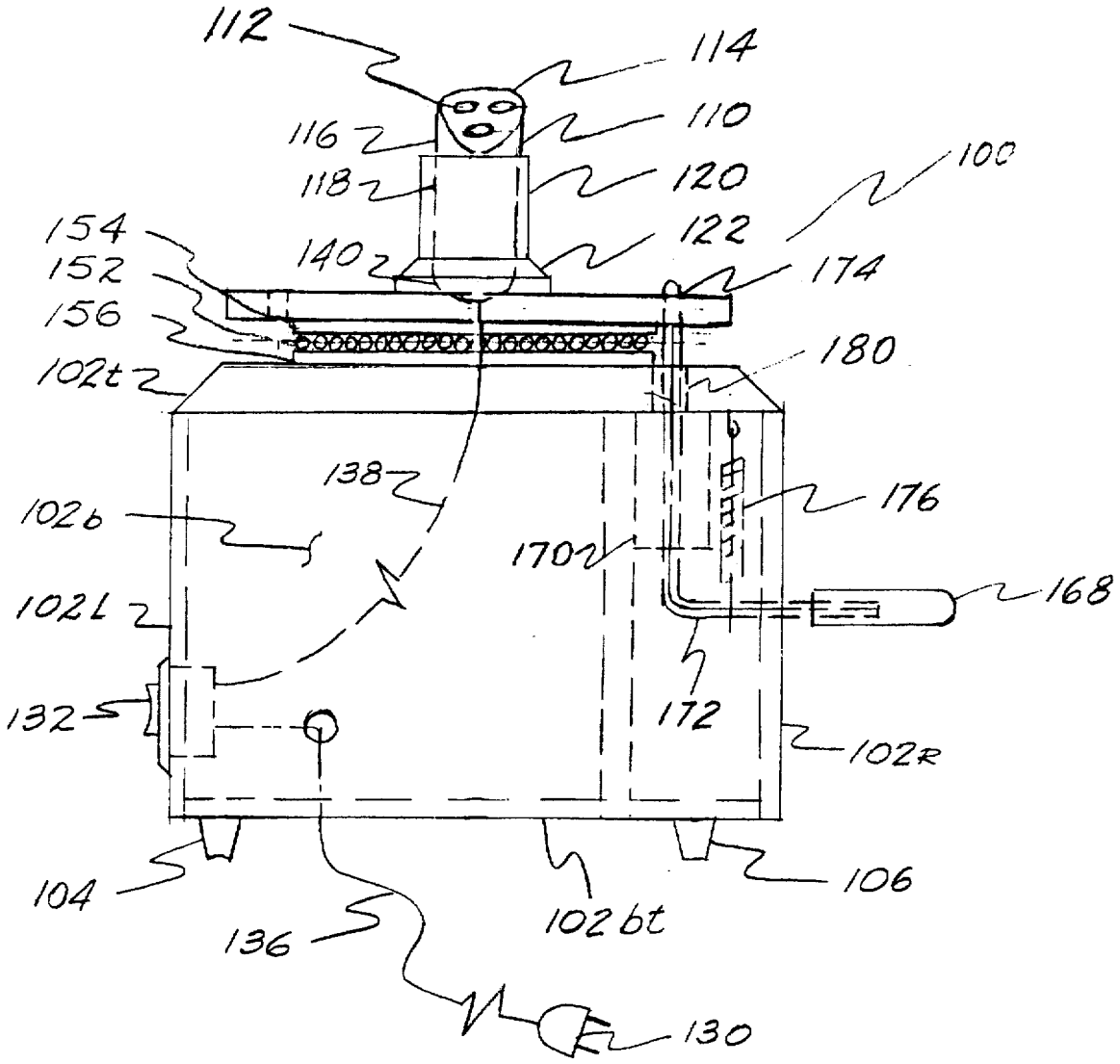
FIG. 1 shows device 100 in perspective.

FIG. 1 shows device 100 of this invention as it would appear in perspective to a user. Device 100 comprises base 102 having six rectangular sides, left **102*l*, right 102*r*, front 102*f*, back 102*b*, top 102*t*, and bottom 102*bt*. Top 102*t* is bolted (not shown) to base 102, the other sides adhered together with adhesive or other adherent along their edges (not shown). Top 102*t* has four contoured edges, the front contoured edge 102*tf*** being depicted.

Base 102 stands firmly in place due to its center of gravity and partly to rubber shoes 104,106 and others (not shown) that prevent base 102 from sliding on, or tipping from, the table or other surface where device 100 is used. Height of base 102 is other surface on which device 100 is used. A user sitting at a table has the user's chin about as high as blades 112 of razor 110.

Electric razor 110, a commercially available corded razor such as a Norelco (TM) 3405LC, snugly fits in tube 120, a section of reinforced, elastomeric tubing. Razor 110 has a switch (not shown) which is turned to the on position. Elastomer washer 122 surrounds tube 120 at its base and is bound to tube 120 around an opening in turntable 150. Lifting razor 110 upward removes razor 110 from tube 120.

Bearings 152 mount between turntable 150 and top **102*t*. Bearings 152 facilitate rotation of turntable 150 around top 102*t*. Bearings 152 are carried between plates 154,156. Plates 154,156 respectively attach to turntable 150 and top 102*t***.

Razor 110 has blades 112. Blades 112 of razor 110 respectively fit around posts (not shown) rotated by razor 110. Housing 114 holds blades 112 atop razor 110. End 116 of razor 110 has curvature (better seen in FIG. 4). Curvature of end 116 from razor handle 118 causes blades 112 to be in a line that is at an oblique angle (about 150 degrees) to handle 118.

Plug 130, a standard household plug, connects to a standard wall socket (not shown). Electricity flows though cord 136 to an electric toggle switch (not shown) behind button 132. Pressure against button 132 opens and closes the toggle switch for controlling electricity through cord 138 and turning razor 110 on and off. Cord 138, extending to razor end 140, has added length allowing turntable 150 to rotate free of interference.

Movement of handle 168 of "L" shaped rod 170 controls capacity of turntable 150 to rotate. When turntable 150 has rotated the razor 110 presents blades 112 differently. Rod 170 holds turntable 150 in place once rotation of turntable 150 has positioned razor 110 as desired. FIG. 1 shows turntable 150 unable to rotate because rod 170, passing through guide hole 180 in top 102*t*, has entered positioning hole 190. When handle 168 pressed downward, rod 170 withdraws from positioning ole 190 and turntable 150 is free to rotate.

Figure 2:
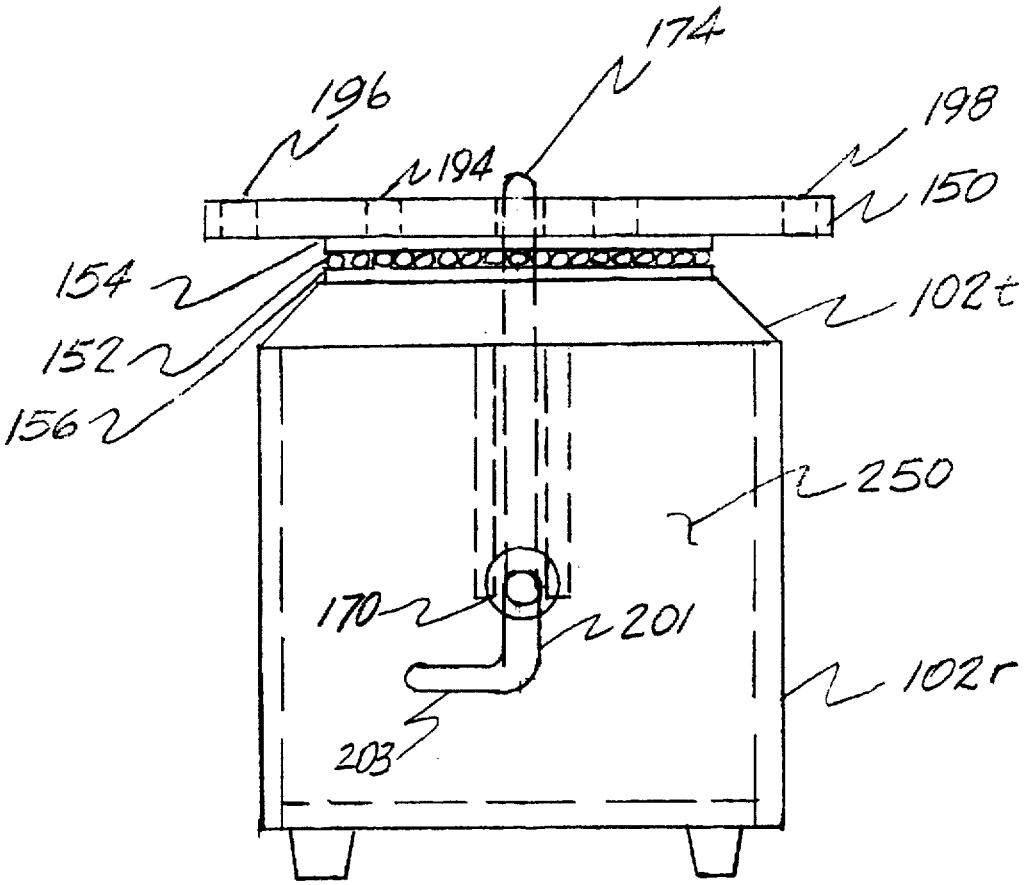
FIG. 2 shows internal features of device 100 of FIG. 1. Shown is a view of a mechanism for rotation control of turntable 150.

Spring loading rod 170 facilitates stopping and starting turntable 150. As also seen in FIG. 2, spring 176, attached to leg 172 of rod 170 and inside top 102*t*, upwardly tensions rod 170. The constant upward force imparted by spring 176 either, when leg 172 is drawn down and over into slot section 203, holds rod 170 in slot section 203 or, when leg 172 is withdrawn from slot section 203 and allowed movement vertically in slot 201, causes leg 174 to enter a positioning hole such as hole 190. Depressing handle 168 takes leg 174 from positioning hole 190 and thereafter permits rotation of turntable 150 by hand or otherwise to any other positioning holes.

FIG. 2 shows rod leg 174 in one of the positioning holes, hole 196. Two positioning holes 194,198 of the eight positioning holes (three of eight shown) of turntable 150 are also depicted. Shown also is "L" shaped slot 201 along which rod 170 travels and slats 220,222 between which rod leg 174 travels. Slats 220,222 rigidly mount on backboard 350 which is fixed in base 102.

Handle 168 permits rod 170 to be grasped and depressed downward out of a positioning hole. Pushing handle 168 downward permits rod leg 172 to be drawn into slot section 203 and held there through spring tension.

Figure 3:
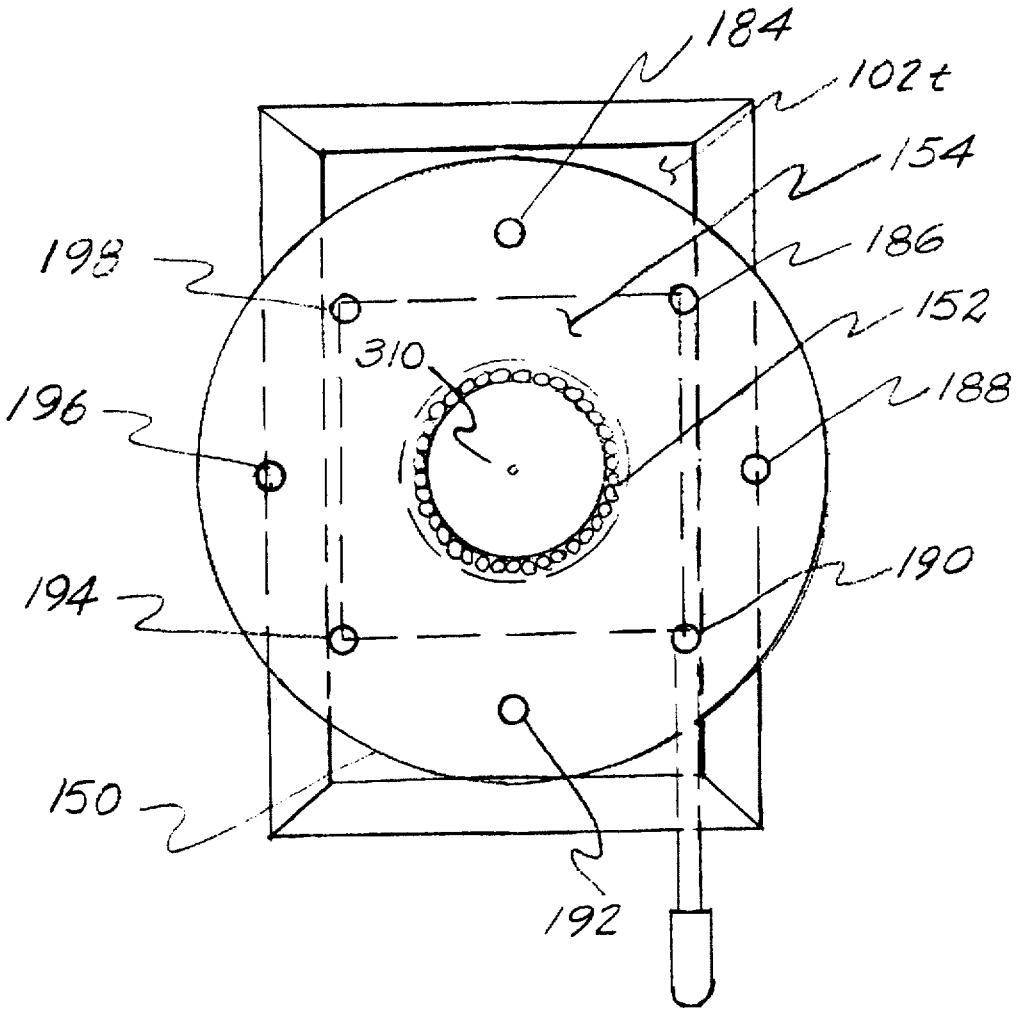
FIG. 3 shows turntable 150 in a plan view with bearings 152 in bearing plate 154 appearing underneath.

FIG. 3, is a plan view of turntable 150. Bearings 152 are in bearing plate 154 which is mounted beneath turntable 150. Turntable 150 has eight positioning holes 184, 186, 188, 190, 192, 194, 196, 198. Opening 310 in bearing plate 156 provides access for electrical connection of razor 110.

Electrical connection permits use of corded razors. Electrical connection also permits charging razors such as Norelco 8225RX (TM) razors. (When rechargeable razors are used, such as a Norelco 825RX(TM), the razor can be turned on and off at the razor but assistance by another may be needed when turning such razors on and off.) Bearing plate (shown as 156 in FIG. 1) of like configuration to plate 154 attaches to plate 154 and provides means for holding bearings 152 and attachment between turntable 150 and top t.

Figure 4:
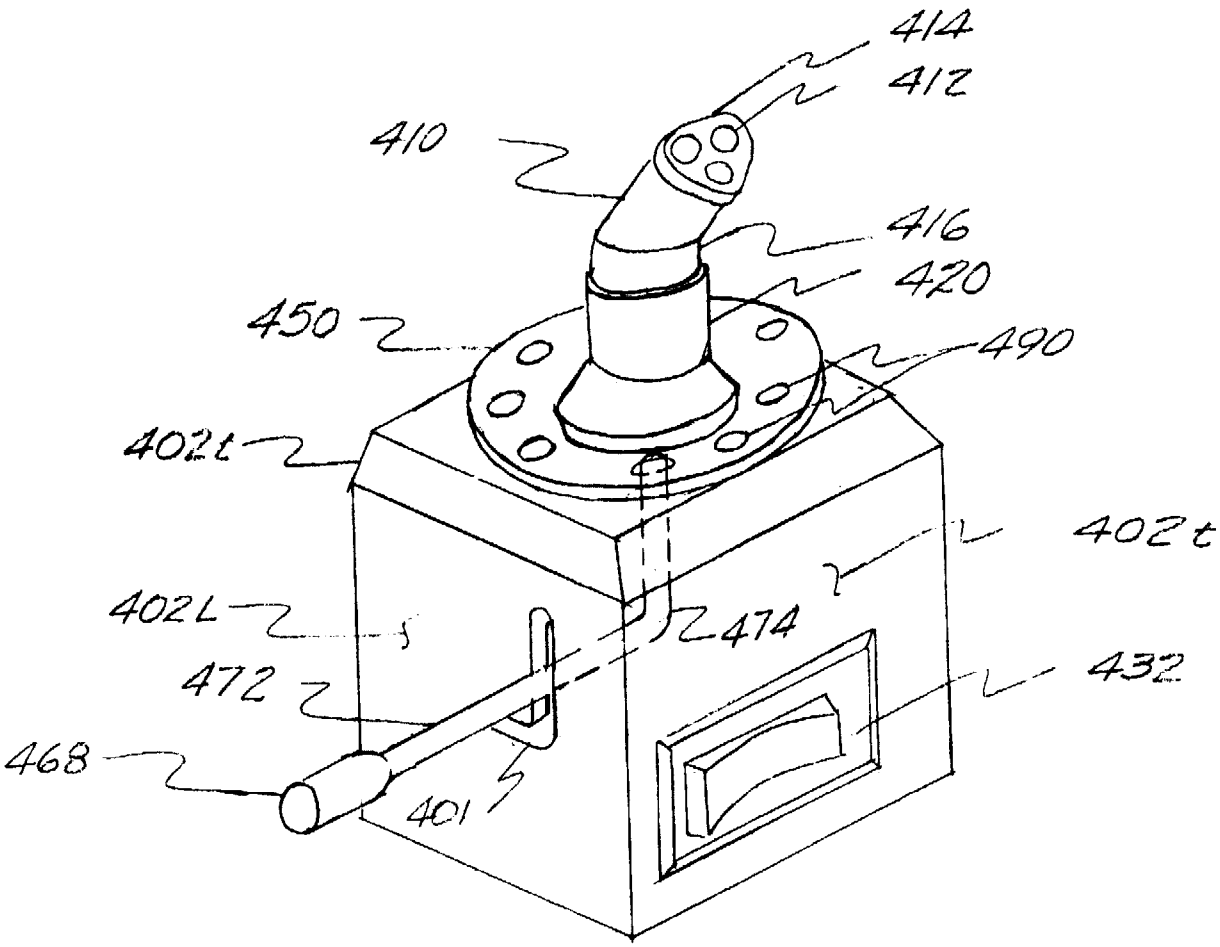
FIG. 4 shows device 400 of this invention.

FIG. 4 shows manipulator 400 with electric razor 410. Razor 410, a commercially available razor, has blades 412 in housing 414 and snugly fits in elastomer tube 420. Curved end 416 curves at an angle from handle 418 of razor 410, as is well known.

FIG. 4 also shows base 402 of manipulator 400, base 402 having six sides top 402*t*, left 402*l*, front 402*f* and others (not shown). Front side has a switch 432 which turns razor 410 on and off. FIG. 4 further shows turntable 450 having eight peripheral positioning holes 490. Vertical leg 474 of rod 470 fits in these positioning holes. Downward pressure against handle 468 moves spring loaded (not shown) leg 472 downward in slot 401 of side 402*l* to disengage leg 474 from its positioning hole. Turntable 450 is then free to be rotated to rotate razor 410 so that blades 412 present differently to the user.

Having described this invention in relation to a certain specific embodiments it will be readily apparent that other embodiments of this invention may be made without departing from the scope of this invention as set forth in the following claims.

What I claim is:

1. An electric razor manipulator, said manipulator enabling a person otherwise having limited ability to use a normally hand held electric razor for shaving facial hair independent of assistance from others, said manipulator comprising:

(a) a firmly standing base having a top and a bottom, said top having an opening extending through said top;

(b) a turntable rotatable about said top, said turntable having an opening that communicates with said opening in said top;

(c) means mounted said turntable for holding said electric razor upright such that blades of said razor stand above said turntable;

(d) means for stopping rotation of said turntable distinctly whereby said razor is rotatable selectively with said turntable.

2. The manipulator in accordance with claim 1, wherein said means mounted said turntable for holding said razor upright comprises an elastomeric tube.

3. The manipulator in accordance with claim 1, wherein said manipulator comprises (i) a turntable having a plurality of positioning holes spaced around a periphery of said periphery, (ii) a guide in said top, said guide registerable with first and other of said positioning holes as said turntable rotates about said top, (iii) a side extending between said top and said bottom, said side having an "L" shaped slot extending a length of said side between said top and said bottom, (iv) an "L" shaped rod having first and second legs and attached to a first of spring ends, said first leg fitting lengthwise in said slot and said second leg fitting endwise respectively in said in said guide and in a first and other of said positioning holes, and (v) a mount for holding a second of said spring ends.

4. The manipulator in accordance with claim 1, which comprises a side extending between said top and said bottom, said side having a switch mounted to said side and capable of electrical communication with said razor and a source of electricity.

* * * * *